US006584945B2

(12) United States Patent
Porth

(10) Patent No.: US 6,584,945 B2
(45) Date of Patent: Jul. 1, 2003

(54) SPARK UNIT FOR COMBUSTION-POWERED DRIVING TOOL

(75) Inventor: Chris H. Porth, Gurnee, IL (US)

(73) Assignee: Illinois Tool Works Inc., Glenview, IL (US)

( * ) Notice: Subject to any disclaimer, the term of this patent is extended or adjusted under 35 U.S.C. 154(b) by 82 days.

(21) Appl. No.: 09/938,043

(22) Filed: Aug. 23, 2001

(65) Prior Publication Data

US 2003/0037746 A1 Feb. 27, 2003

(51) Int. Cl.[7] ..... F02P 15/00

(52) U.S. Cl. ..... 123/169 EL; 123/163; 123/46 SC

(58) Field of Search ..... 123/46 R, 46 SC, 123/46 H, 163, 169 EL, 169 E

(56) References Cited

U.S. PATENT DOCUMENTS

| | | | | | |
|---|---|---|---|---|---|
| 4,405,072 | A | * | 9/1983 | Kindle et al. | 227/10 |
| 4,821,683 | A | | 4/1989 | Veldman | 123/46 SC |
| 5,000,128 | A | | 3/1991 | Veldman | 123/46 C |
| 5,263,439 | A | * | 11/1993 | Doherty et al. | 123/46 SC |
| 5,713,313 | A | * | 2/1998 | Berry | 123/46 SC |
| 5,752,643 | A | * | 5/1998 | MacVicar et al. | 227/10 |
| 5,909,836 | A | * | 6/1999 | Shkolnikov et al. | 227/8 |
| 6,016,945 | A | * | 1/2000 | Phillips et al. | 227/10 |
| 6,019,072 | A | * | 2/2000 | Phillips et al. | 123/46 H |
| 6,158,643 | A | | 12/2000 | Phillips | 123/46 C |

FOREIGN PATENT DOCUMENTS

| | | | | |
|---|---|---|---|---|
| WO | WO-00/73650 | * | 12/2000 | F02P/15/04 |

* cited by examiner

*Primary Examiner*—Tony M. Argenbright
*Assistant Examiner*—Hai H Huynh
(74) *Attorney, Agent, or Firm*—Schwartz & Weinrieb

(57) ABSTRACT

A spark unit for an internal combustion fastener-driving tool comprises a spark plug body mounted within a boss portion of the tool cylinder head, and a spark unit cathode electrode is mounted within the spark plug body in such a manner that the tip portion of the spark unit cathode electrode projects below or away from the bottom or under-surface portion of the cylinder head mounting boss. In this manner, the tip portion of the spark unit cathode electrode is not disposed within a recess or pocket region so as not to tend to accumulate dirt or oil deposits which can tend to foul or otherwise adversely affect the sparking and ignition characteristics of the spark plug assembly and the operation of the fastener-driving tool.

27 Claims, 3 Drawing Sheets

SPARK UNIT FOR COMBUSTION-POWERED DRIVING TOOL

FIELD OF THE INVENTION

The present invention relates generally to a spark unit for an internal combustion-powered fastener driving tool, and more particularly to a new and improved spark unit for an internal combustion-powered fastener driving tool wherein the unique and novel structure of the new and improved spark unit of the present invention effectively prevents the buildup and accumulation of dirt and oil such that the spark unit can be utilized for substantially longer periods of times without requiring maintenance and cleaning, and wherein further, quicker and more intense sparking of the unit is able to be achieved.

BACKGROUND OF THE INVENTION

Combustion-powered fastener driving tools conventionally comprise a combustion chamber wherein a predetermined amount of combustible fuel is ignited within a combustion chamber so as to accordingly drive a piston which is operatively connected to a fastener drive blade or drive member. As the driver blade or driver member is driven, for example, downwardly by means of the piston, the driver blade or driver member will accordingly drive a fastener, disposed, for example, within a tool magazine containing a multiplicity of fasteners, into, for example, a suitable substrate.

A conventional internal combustion fastener driving tool is disclosed, for example, within U.S. Pat. No. 6,158,643 which issued to Phillips on Dec. 12, 2000. As can readily be seen in FIG. 1, which corresponds to FIG. 10 of the noted patent, a cylinder head is disclosed at 32, and a spark plug 40, which comprises a spark plug body 238 and a spark plug electrode 39, is mounted within the cylinder head 32. Spark plug body 238 has a spark plug O-ring 262, as well as a valve support 41, mounted thereon. Spark plug body 238 further defines an axial bore 240 which is arranged to house spark plug electrode 39 and which is also arranged to house a spark plug connector end portion of a piezoelectric conductor 224. An electrode 36, comprising a pin 202, is mounted upon an accelerator plate 33, and the electrode 36 and spark plug 40 are disposed opposite each other so as cooperate together and thereby define a spark gap 198 therebetween. It is further seen that the spark plug electrode 39 is actually mounted within the axial bore 240 of the spark plug body 238 in a recessed manner with respect to a front surface portion 237 of the spark plug body 238 such that an annular pocket or recess 239 is defined around the front tip portion of the spark plug electrode 39. While a combustion system such as, or similar to, the combustion system of the internal combustion fastener driving tool of Phillips usually operates quite satisfactorily, it has been experienced that over time, the disposition of the spark plug electrode 39 within the spark plug body 238, and in particular, within the recessed or pocket region 239, tends to result in the accumulation of dirt and/or oil within such recessed or pocket region 239 around the front tip portion of the spark plug electrode 39. Such an accumulation of dirt and oil can lead to difficulties in obtaining or achieving the proper and timely ignition of the spark plug electrode 39, and in addition, or alternatively, can require more frequent maintenance in order to maintain the recessed region 239 substantially free of oil and dirt.

A need therefore exists in the art for a new and improved spark unit or assembly for use within an internal combustion fastener-driving tool wherein the spark unit is mounted in such a manner that the spark unit electrode is not disposed within a recessed or pocket region and will in fact be disposed such that the free end or spark emitting tip portion of the spark unit electrode projects outwardly from the component within which the spark unit electrode is fixedly mounted such that oil and dirt is effectively prevented from accumulating around the spark unit electrode.

OBJECTS OF THE INVENTION

Accordingly, it is an object of the present invention to provide a new and improved spark unit or assembly for use within an internal combustion fastener-driving tool.

Another object of the present invention is to provide a new and improved spark unit or assembly for use within an internal combustion fastener-driving tool wherein the spark unit electrode is mounted in such a manner that operational disadvantages and drawbacks characteristic of PRIOR ART internal combustion fastener driving tool spark units or assemblies are effectively overcome.

An additional object of the present invention is to provide a new and improved spark unit or assembly for use within an internal combustion fastener-driving tool wherein the spark unit electrode is mounted in such a manner that the free end or spark emitting tip portion of the spark unit electrode projects outwardly from the component within which the spark unit electrode is fixedly mounted such that oil and dirt is effectively prevented from accumulating around the spark unit electrode.

A further object of the present invention is to provide a new and improved spark unit or assembly for use within an internal combustion fastener-driving tool wherein the spark unit electrode is mounted in such a manner that the free end or spark emitting tip portion of the spark unit electrode projects outwardly from the component within which the spark unit electrode is fixedly mounted such that oil and dirt is effectively prevented from accumulating around the spark unit electrode whereby improved spark ignition properties or characteristics of the tool are able to be achieved.

A last object of the present invention is to provide a new and improved spark unit or assembly for use within an internal combustion fastener-driving tool wherein the spark unit electrode is mounted in such a manner that the free end or spark emitting tip portion of the spark unit electrode projects outwardly from the component within which the spark unit electrode is fixedly mounted such that oil and dirt is effectively prevented from accumulating around the spark unit electrode whereby improved spark ignition properties or characteristics of the tool are able to be achieved while minimizing maintenance requirements.

SUMMARY OF THE INVENTION

The foregoing and other objectives are achieved in accordance with the teachings and principles of the present invention through the provision of a new and improved spark unit or assembly for use within an internal combustion fastener-driving tool wherein the spark unit electrode is fixedly mounted within the aluminum cast cylinder head such that the free end or spark emitting tip portion of the spark unit electrode projects outwardly from the outer surface of the cylinder head which defines one wall of the combustion chamber. In this manner, since the free end or spark emitting tip portion of the spark unit electrode is projects outwardly from the outer surface of the cylinder head and is not disposed within a recessed portion or pocket, oil and dirt is effectively prevented from accumulating around the spark unit electrode whereby improved spark ignition properties or characteristics of the tool are able to be achieved while minimizing maintenance requirements.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
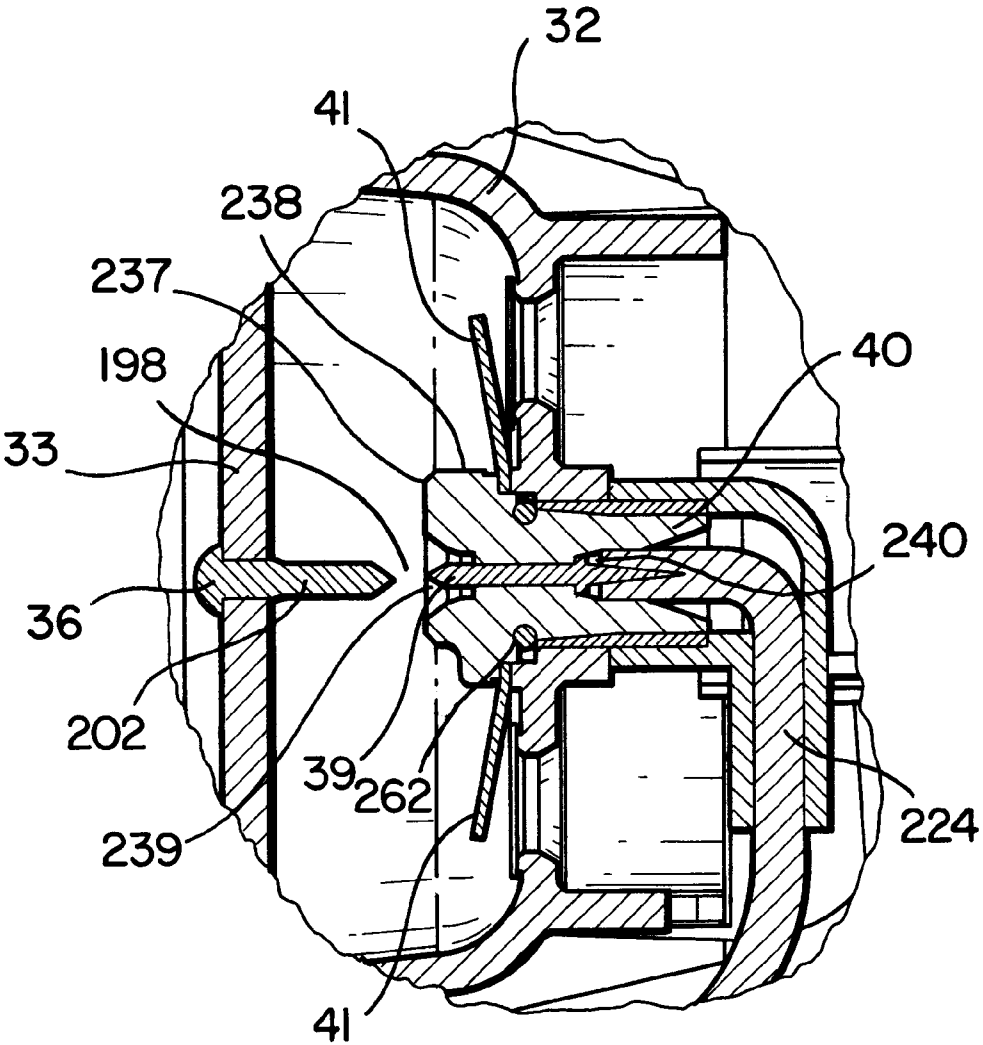
FIG. 1 (PRIOR ART)
FIG. 1 is a partial cross-sectional view of a PRIOR ART internal combustion fastener-driving tool showing the conventional mounting of a spark electrode within the spark plug assembly.
Figure 2:
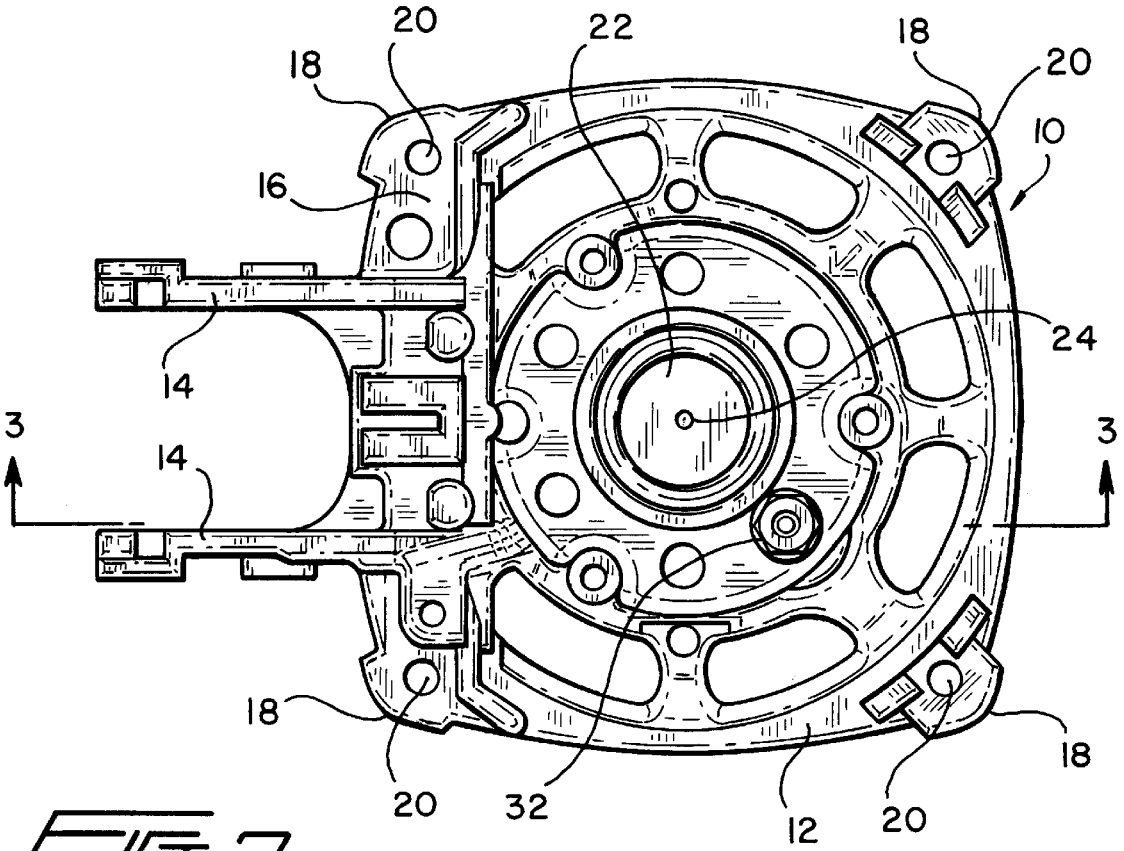
FIG. 2 is a top plan view of a new and improved spark unit or assembly, for use within an internal combustion fastener-driving tool, constructed in accordance with the principles and teachings of the present invention and showing the cooperative parts thereof.
Figure 3:
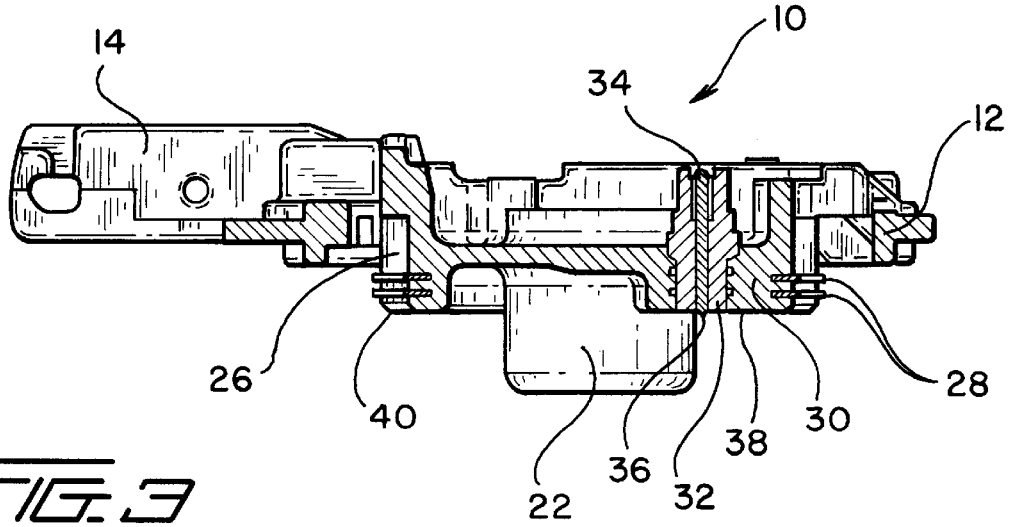
FIG. 3 is a cross-sectional view of the new and improved spark unit or assembly as disclosed within FIG. 2 as taken along the lines 3—3 of FIG. 2.
Figure 4:
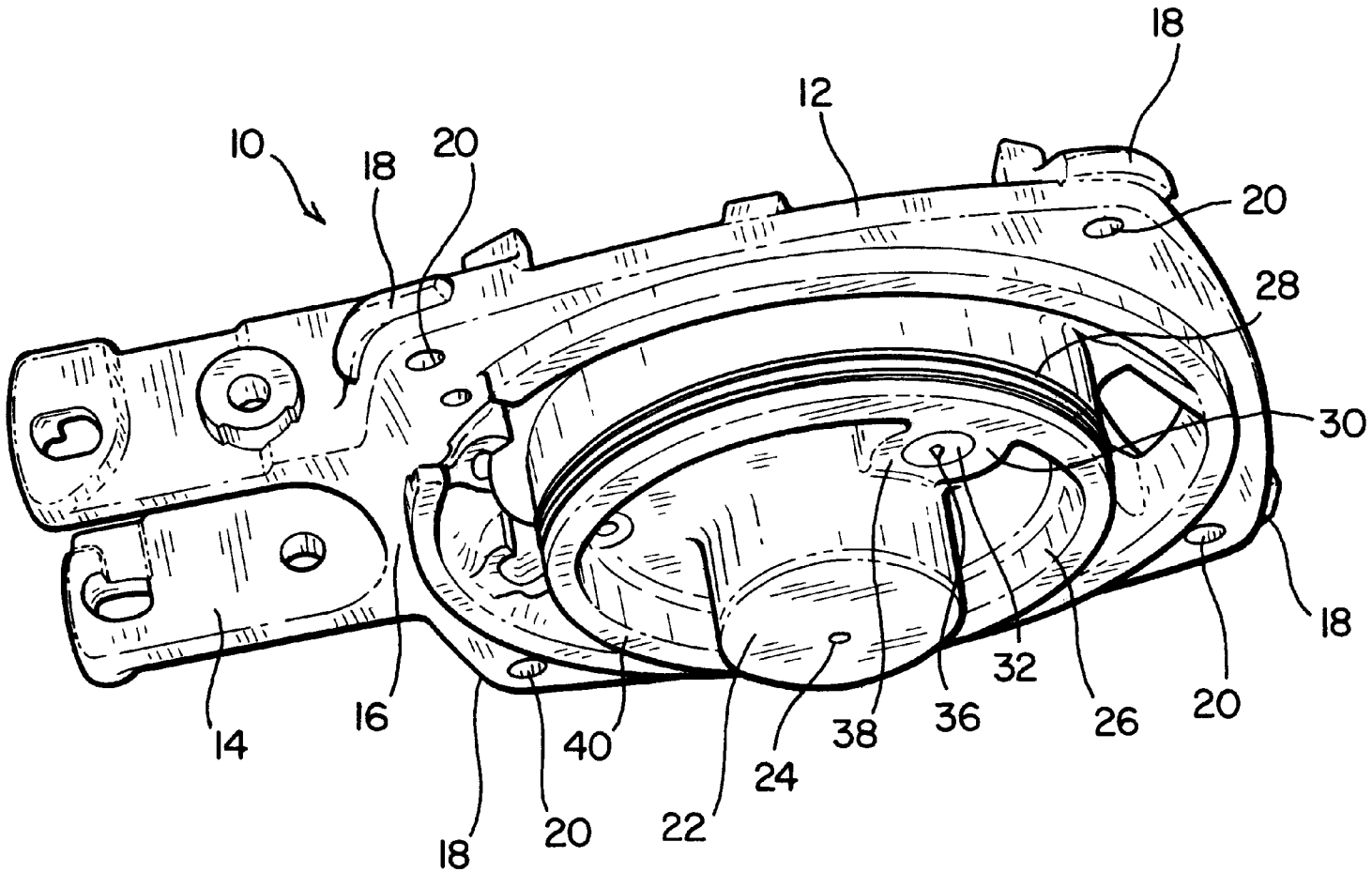
FIG. 4 is a bottom perspective view of the new and improved spark unit or assembly as disclosed within FIGS. 2 and 3.

Referring now to the drawings, and more particularly to FIGS. 1–3 thereof, a new and improved spark unit or assembly, for use within an internal combustion fastener-driving tool and constructed in accordance with the principles and teachings of the present invention, is disclosed and is generally indicated by the reference character 10. More particularly, the new and improved spark unit or assembly 10 is seen to comprise a one-piece, aluminum cast cylinder head 12, and as best seen in FIG. 2, cylinder head 12 has a substantially square-shaped configuration. Cylinder head 12 includes a clevis portion 14 integrally attached to, for example, the left side wall portion 16 of the cylinder head 12, and the clevis portion 14 comprises means by which the cylinder head 12 is mounted within a handle portion, not shown, of an internal combustion fastener-driving tool, also not shown. The corner regions of the cylinder head 12 are provided with boss-like structures 18 through which holes or apertures 20 are provided for receiving suitable fasteners, not shown, by means of which a cylinder head cap, also not shown, may be secured to the cylinder head 12. The cylinder head 12 is adapted to define one wall of a combustion chamber, not shown, of the internal combustion fastener-driving tool, not shown, when the combustion chamber is closed during an internal combustion cycle, and at the vertical, axial center of the cylinder head 12, there is provided a motor mount housing 22 within which a motor, not shown, may be mounted. The motor, not shown, is adapted to be operatively connected to a fan, also not shown, which is provided in a conventional manner within the tool combustion chamber, not shown, for the purpose of stirring, mixing, and uniformly disbursing the fuel-air mixture within and throughout the combustion chamber, not shown. The motor mount housing 22 is provided with an aperture 24, as seen in FIGS. 2 and 4, through which a drive shaft, not shown, of the motor, not shown, can pass so as to be operatively connected to the combustion chamber fan, not shown, in order to operatively rotate the combustion chamber fan during an internal combustion cycle. It is lastly seen in connection with the structure of the cylinder head 12 that an axially, downwardly extending sealing body 26, as best seen in FIGS. 3 and 4, annularly surrounds the motor mount housing 22, and a plurality of steel sealing rings 28 are fixedly mounted within the external peripheral surface of the annular sealing body 26 so as to provide a fluidic seal within the combustion chamber when the combustion chamber is disposed in a CLOSED state during an internal combustion operative cycle.

In connection with the unique and novel structure for mounting the spark unit or assembly upon the cylinder head 12, and in accordance with the principles and teachings of the present invention for providing the necessarily desired level of ignition within the combustion chamber of the internal combustion fastener driving tool, not shown, a mounting boss 30 is integrally formed with, and radially inteposed between, the motor mount housing 22 and the annular sealing body 26. An insulative plastic spark plug body 32 is fixedly mounted within the mounting boss 30, and a spark electrode 34 is coaxially mounted within the spark plug body 32. As best seen in FIG. 3, the upper end portion of the spark electrode 34 comprises a relatively thick portion to which high voltage, generated by means of a suitable microprocessor, not shown, and within the range of 6,000–22,000 volts, is applied, while the lower end portion of the spark electrode 34 comprises a relatively thin portion which terminates in a spark electrode or spark unit tip 36. The spark electrode 34 is fabricated from a suitable steel, and serves as the cathode of the ignition circuit, while the aluminum cast cylinder head 12 serves as the anode of the ignition circuit. The tip portion 36 of the spark unit electrode 34 has a conically-shaped configuration, and in accordance with the critically important feature of the present invention, and as can best be appreciated from FIGS. 3 and 4, the tip portion 36 of the spark unit electrode 34 projects axially downwardly below or beneath the bottom or undersurface portions 38 and 40, respectively, of both the mounting boss 30 and the annular sealing body 26, wherein the bottom or undersurface portions 38,40 of the boss 30 and body 26 are disposed internally within the combustion chamber.

In this manner, when the voltage is discharged from the tip portion 36 of the spark unit cathode electrode 34, it generates a spark between the tip portion 36 and the surrounding cast aluminum cylinder head 12, and more particularly between the tip portion 36 of the spark unit cathode electrode 34 and the mounting boss 30 and annular sealing body 26 portions of the cylinder head 12, whereby as the generated spark effectively jumps from the tip portion 36 of the spark unit cathode electrode 34 to the mounting boss 30 and annular sealing body 26 portions of the cylinder head 12, the fuel mixture present within the combustion chamber, not shown, is ignited. It is to be emphasized that as a result of the disposition of the spark unit cathode electrode 34 as mounted within the spark plug body 32 in such a manner that the downwardly projecting tip portion 36 of the spark unit cathode electrode 34 projects outwardly and downwardly away from and beyond the bottom or undersurface portion 38, for example, of the mounting boss 30, there is no recess or pocket, as is characteristic of the PRIOR ART spark plug electrode mounting system such as that shown in the aforenoted patent to Phillips. Accordingly, dirt and oil are effectively prevented from collecting within the region immediately disposed around the spark generating tip portion 36 of the spark unit cathode electrode 34, and therefore, improved sparking cycles and ignition operations are able to be achieved. In addition, required maintenance cycles are lengthened in view of the fact that more frequent cleaning operations in connection with the spark generator regions need not be performed.

Thus, it may be seen that in accordance with the principles and teachings of the present invention, there has been provided a new and improved spark unit for use in connection with an internal combustion fastener-driving tool wherein the spark unit cathode electrode has its tip portion disposed below or beneath the external bottom or undersurface portion of its mounting boss such that the tip portion of the spark unit cathode electrode is entirely exposed and not in fact disposed within a recess or pocket region defined within the mounting boss or other similar mounting structure. In this manner, oil and dirt are effectively prevented from collecting within the region immediately surrounding the spark unit cathode electrode tip portion. As a result of such a mounting system for the spark unit cathode electrode, improved sparking levels or characteristics are achieved, and in addition, maintenance requirements or cleaning operations are reduced.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States of America, is:

1. A spark unit for use in connection with an internal combustion fastener-driving tool, comprising:

a cylinder head for defining one wall of a combustion chamber defined within an internal combustion fastener-driving tool, wherein said cylinder head has a surface portion which is adapted to be disposed internally within the combustion chamber and which serves as an anode electrode;

a spark plug body mounted within said cylinder head; and a spark unit cathode electrode, comprising a spark tip portion, mounted within said spark plug body so as to operatively cooperate with said anode electrode surface portion of said cylinder head so as to generate a spark therebetween, and wherein said spark tip portion projects outwardly away from said surface portion of said cylinder head which is adapted to be disposed internally within the combustion chamber of the tool so that said spark tip portion of said spark unit cathode electrode is not disposed within a recessed region whereby oil and dirt deposits will not tend to accumulate within the immediate vicinity surrounding said spark tip portion of said spark unit cathode electrode so as not to foul and adversely affect the sparking and ignition characteristics of said spark unit.

2. The spark unit as set forth in claim 1, wherein:

said cylinder head comprises am aluminum cast body; and said spark unit cathode electrode is fabricated from steel.

3. The spark unit as set forth in claim 1, wherein:

said cylinder head comprises a mounting boss within which said spark plug body is mounted; and said surface portion of said cylinder head which is adapted to be disposed internally within the combustion chamber of the internal combustion fastener driving tool comprises a bottom surface portion of said mounting boss.

4. The spark unit as set forth in claim 3, wherein:

said cylinder head further comprises an annular sealing body having a plurality of annular sealing rings fixedly mounted thereon for sealing the combustion chamber when the combustion chamber is disposed in a CLOSED state.

5. The spark unit as set forth in claim 4, wherein:

said cylinder head further comprises a motor mount housing for mounting a drive motor for driving an air-fuel mixture fan within the combustion chamber of the internal combustion fastener driving tool.

6. The spark unit as set forth in claim 5, wherein:

said mounting boss, upon which said spark plug body and said spark unit cathode electrode are mounted, is radially interposed between said motor mount housing and said annular sealing body.

7. The spark unit as set forth in claim 1, wherein:

said spark plug body is fabricated from an insulative plastic material.

8. The spark unit as set forth in claim 1, wherein:

a clevis portion is integrally formed with said cylinder head for mounting said cylinder head within a handle portion of the fastener driving tool.

9. The spark unit as set forth in claim 1, wherein:

said spark tip portion of said spark unit cathode electrode has a substantially conical configuration.

10. An internal combustion fastener-driving tool, comprising:

a cylinder head for defining one wall of a combustion chamber defined within said internal combustion fastener-driving tool, wherein said cylinder head has a surface portion which is adapted to be disposed internally within the combustion chamber and which serves as an anode electrode; and a spark unit mounted within said cylinder head;

said spark unit comprising a spark plug body; and a spark unit cathode electrode, comprising a spark tip portion, mounted within said spark plug body so as to operatively cooperate with said anode electrode surface portion of said cylinder head so as to generate a spark therebetween, and wherein said spark tip portion projects outwardly away from said surface portion of said cylinder head which is adapted to be disposed internally within the combustion chamber of said tool so that said spark tip portion of said spark unit cathode electrode is not disposed within a recessed region whereby oil and dirt deposits will not tend to accumulate within the immediate vicinity surrounding said spark tip portion of said spark unit cathode electrode so as not to foul and adversely affect the sparking and ignition characteristics of said spark unit of said fastener driving tool.

11. The fastener driving tool as set forth in claim 10, wherein:

said cylinder head comprises am aluminum cast body; and said spark unit cathode electrode is fabricated from steel.

12. The fastener driving tool as set forth in claim 10, wherein:

said cylinder head comprises a mounting boss within which said spark plug body is mounted; and said surface portion of said cylinder head which is adapted to be disposed internally within the combustion chamber of the internal combustion fastener driving tool comprises a bottom surface portion of said mounting boss.

13. The fastener driving tool as set forth in claim 12, wherein:

said cylinder head further comprises an annular sealing body having a plurality of annular sealing rings fixedly mounted thereon for sealing the combustion chamber when the combustion chamber is disposed in a CLOSED state.

14. The fastener driving tool as set forth in claim 13, wherein:

said cylinder head further comprises a motor mount housing for mounting a drive motor for driving an air-fuel mixture fan within the combustion chamber of the internal combustion fastener driving tool.

15. The fastener driving tool as set forth in claim 14, wherein:

said mounting boss, upon which said spark plug body and said spark unit cathode electrode are mounted, is radially interposed between said motor mount housing and said annular sealing body.

16. The fastener driving tool as set forth in claim 10, wherein:

said spark plug body is fabricated from an insulative plastic material.

17. The fastener driving tool as set forth in claim 10, wherein:

a clevis portion is integrally formed with said cylinder head for mounting said cylinder head within a handle portion of the fastener driving tool.

18. The fastener driving tool as set forth in claim 10, wherein:

said spark tip portion of said spark unit cathode electrode has a substantially conical configuration.

19. A spark unit, for use in conjunction with an internal combustion fastener-driving tool, comprising a cylinder head for defining one wall of a combustion chamber defined within an internal combustion fastener-driving tool, and a spark plug body mounted within said cylinder head, the improvement comprising:

said cylinder head has a surface portion which is adapted to be disposed internally within the combustion chamber of the tool and which serves as an anode electrode;

a spark unit cathode electrode, comprising a spark tip portion, mounted within said spark plug body so as to operatively cooperate with said anode electrode surface portion of said cylinder head so as to generate a spark therebetween;

said spar tip portion projecting outwardly away from said surface portion of said cylinder head, which is adapted to be disposed internally within the combustion chamber of the tool, so that said spark tip portion of said spark unit cathode electrode is not disposed within a recessed region whereby oil and dirt deposits will not tend to accumulate within the immediate vicinity surrounding said spark tip portion of said spark unit cathode electrode so as not to foul and adversely affect the sparking and ignition characteristics of said spark unit.

20. A The spark unit a set forth in claim 19, wherein:

said cylinder head comprises am aluminum cast body; and said spark unit cathode electrode is fabricated from steel.

21. The spark unit a set forth in claim 19, wherein: said cylinder head comprises a mounting boss within which said spark lug body is mounted; and said surface portion of said cylinder head which is adapted to be disposed internally within the combustion chamber of the internal combustion fastener driving tool comprises a bottom surface portion of said mounting boss.

22. The spark unit as set forth in claim 21, wherein:

said cylinder head further comprises an annular sealing body having a plurality of annular sealing rings fixedly mounted thereon for sealing the combustion chamber when the combustion chamber is disposed in a CLOSED state.

23. The spark unit as set forth in claim 22, wherein:

said cylinder head further comprises a motor mount housing for mounting a drive motor for driving an air-fuel mixture fan within the combustion chamber of the internal combustion fastener driving tool.

24. The spark unit as set forth in claim 23, wherein:

said mounting boss, upon which said spark plug body and said spark unit cathode electrode are mounted, is radially interposed between said motor mount housing and said annular sealing body.

25. The spark units set forth in claim 19, wherein: said spar plug body is fabricated from an insulative plastic material.

26. The spark unit as set forth in claim 19, wherein:

a clevis portion is integrally formed with said cylinder head for mounting said cylinder head within a handle portion of the fastener driving tool.

27. The spark unit as set forth in claim 19, wherein:

said spark tip portion of said spark unit cathode electrode has a substantially conical configuration.

* * * * *